United States Patent [19]

Plante et al.

[11] 3,986,901

[45] Oct. 19, 1976

[54] CONTROLLED CATALYST FOR MANUFACTURING MAGNETIC ALLOY PARTICLES HAVING SELECTIVE COERCIVITY

[75] Inventors: Franklin T. Plante, Longmont; Raymond F. Sankuer, Boulder, both of Colo.

[73] Assignee: International Business Machines Corporation, Armonk, N.Y.

[22] Filed: Apr. 30, 1975

[21] Appl. No.: 573,234

[52] U.S. Cl. ..... 148/105; 75/0.5 AA; 427/128

[51] Int. Cl.[2] ..... H01F 1/02

[58] Field of Search ..... 148/105; 75/0.5 AA, 75/122, 120; 427/129, 132, 128

[56] References Cited

UNITED STATES PATENTS

| | | | |
|---|---|---|---|
| 3,138,476 | 6/1964 | Foley | 148/105 |
| 3,282,723 | 11/1966 | Melillo | 427/129 |
| 3,494,760 | 2/1970 | Ginder | 75/0.5 AA |
| 3,525,635 | 8/1970 | Haller | 427/132 |
| 3,672,867 | 6/1972 | Little | 148/105 |
| 3,702,263 | 11/1972 | Hall et al. | 427/132 |
| 3,726,664 | 4/1973 | Parker et al. | 75/0.5 A |
| 3,756,866 | 9/1973 | Parker et al. | 148/105 |
| 3,856,513 | 12/1974 | Chen et al. | 75/122 |

*Primary Examiner*—Walter R. Satterfield
*Attorney, Agent, or Firm*—Gunter A. Hauptman; Herbert F. Somermeyer; Donald W. Margolis

[57] ABSTRACT

This invention provides techniques for producing unique cobalt-phosphorus (Co-P) particles. The Co-P particles produced by this technique are novel as to both size and morphology. Their size is uniformly less than about 300 A, with average sizes being about 150 A. This is substantially smaller than Co-P particles previously known or reported in the literature. Their morphology is unique, as shown by x-ray and electron diffraction, in that they are amorphous. All known prior art Co-P particles have been crystalline. In addition, these Co-P particles have the capability of being manufactured with selectively controlled magnetic coercivity.

The new reaction system utilized to produce these unique materials provides a substantial departure from art known systems. The reaction system is notable for changes in materials and procedures previously considered important or indispensable to the production of magnetic Co-P and for its ability to control the coercivity of the particles produced over a broad range as an inverse function of the concentration of the palladium cation ($Pd^{++}$) catalyst used. More specifically, the reaction system is extremely novel in terms of the fact that: (1) it is initiated at ambient rather than elevated temperatures; (2) excludes all complexing agents, both strong and weak, from the reaction system; (3) excludes magnetic fields of every form and magnitude during the reaction; and (4) can be utilized to provide Co-P particles of selected coercivity in the range of about 500 to 1500 oersteds as an inverse function of the Pd cation catalyst concentration utilized.

8 Claims, 2 Drawing Figures

CONTROLLED CATALYST FOR MANUFACTURING MAGNETIC ALLOY PARTICLES HAVING SELECTIVE COERCIVITY

BACKGROUND OF THE INVENTION

1. Field of the Invention

This invention relates to a novel method for preparing extremely small amorphous magnetic cobalt-phosphorus (Co-P) alloy particles having selectively controlled coercivity by chemical reduction from solutions including controlled palladium cation ($Pd^{++}$) catalyst concentrations. Such particles are suitable for use in magnetic recording media, permanent magnets, magnetic cores, and in magnetically responsive fluid suspensions, such as magnetic or electrostrictive clutch couplings or the like.

2. Description of the Prior Art

In the prior art, magnetic alloys have been prepared in numerous ways. In one common type of preparation, solutions of cobalt, iron, or nickel salts, or mixtures thereof, are subjected to chemical reduction by the action of a reducing agent on the metal cations. In the prior art, such chemical or electroless reduction procedures have most often been carried out to produce continuous films or coatings. The pioneering effort with regard to electroless cobalt plating is detailed in U.S. Pat. No. 2,532,284. In such electroless plating procedures, reducing agents have commonly been of the hypophosphite, boron-nitrogen, borohydride, or organic formate type. It had been observed that in such electroless film plating procedures the plating bath is sometimes subjected to spontaneous decomposition, whereby a large portion of the metal cation content of the solution is vigorously and quickly reduced to a metallic state. The metallic material thus produced is normally a mixture of particles and discontinuous film covering a wide range of sizes, shapes and coercivities. Such catastrophic decomposition during film plating is usually brought about by excessive heating of the electroless solution, a change in the pH of the solution, the build-up of nucleating sites of the bath or the addition of catalytic material to the bath.

Recently, electroless-type baths including cobalt, iron or nickel salts have been used to intentionally produce finely divided particles having uniform size and useful magnetic characteristics. In such controlled decomposition reactions temperature, pH, and metal and reducing agent concentration parameters have been utilized to vary the physical properties, primarily the size, of the particles. To the extent that the magnetic properties of the particles are a function of size, the magnetic properties are also affected by these parameters. The catalytic material most often used for initiating controlled chemical reduction of magnetic metal salts to form particles has been finely divided palladium metal or salts of palladium in the form of a solution including hydrochloric acid. Recently, in U.S. Pat. No. 3,494,760 production of uniform magnetic Co-P particles was reported as having been accomplished by halting the initial palladium catalyzed reaction, removing the catalytic reaction particles, and then utilizing the residual seeding mixture with additional quantities of metal salts and reducing agents, to produce magnetic metal alloy particles of controlled size. Also of interest is the initiation of particle production without utilizing catalytic materials within the bath as reported in commonly assigned U.S. Pat. Nos. 3,726,664 and 3,859,130 in which a combination of amine borane and hypophosphite reducing agents is utilized to initiate production of metal alloy particles without a catalyst.

Control of magnetic characteristics of continuous alloy films deposited from electroless plating baths has been investigated and reported extensively. Perhaps the most complete report of the relationships between the coercivity of electrolessly plated cobalt films and bath parameters is to be found in U.S. Pat. No. 3,138,479. This reference teaches control of cobalt film coercivity by the combined control of pH (with $NH_4OH$) in the range of 7 to 9, agitation up to 350 RPM, sodium hypophosphite reducing agent concentration, temperature in the range of 140° to 200° F (60° to 93° C), and other parameters which are not germane to particle preparation, such as substrate preparation and film thickness. Of interest is the discovery reported in this reference that while each of these parameters had some combined effect on coercivity, pH is the most critical factor.

Neither cobalt-phosphorus film nor particles can be produced by hypophosphite reduction from an electroless bath which is not basic. Most work on the production of continuous cobalt-phosphorus films by electroless plating has been done in basic baths in which the pH is controlled with ammonium hydroxide. However, other bases have also been used in these bath compositions.

Ingredients which form complexes or chelates with cobalt cations are normally included in electroless plating baths whether they are intended to produce films or particles. Cobalt complexing and chelating agents include, for example, ammonia, the primary, secondary and tertiary amines, imines, mono- and di-carboxy groups, saturated unsubstituted short chain aliphatic dicarboxycylic anions and hydroxy groups. Control of coercivity in electrolessly plated cobalt films by controlling the concentrations or ratios of complexing and of chelating agents has been taught, for example, in U.S. Pat. Nos. 3,360,397; 3,423,214; and 3,446,657 and Tsu et al: IBM TECHNICAL DISCLOSURE BULLETIN, Volume 4, No. 8, page 52, January 1962.

Until recently, little has been reported on the control of magnetic properties of cobalt particles produced by decomposition of electroless baths. Results of studies concurrent with the present invention now indicate that the coercivity of magnetic Co-P particles is affected in many ways which would be predictable to one skilled in the art of electroless plating. It also indicates that coercivity is surprisingly unaffected by other parameters.

However, no relationship between the concentration of Pd cation catalyst and film or particle coercivity is known to have been reported.

Recently, methods of making finely divided magnetic cobalt-phosphorus alloy particles with selectively controlled high coercivity by chemical oxidation-reduction have been reported in commonly assigned U.S. Pat. No. 3,756,866. This is accomplished by dissolving a salt of cobalt in a bath rendered basic by a non-complexing source of hydroxyl ions and reducing the metal salt with hypophosphite anion while selectively controlling the temperatures of the bath, thereby precipitating cobalt-phosphorus particles having selected coercivity.

The present invention provides a highly effective alternative technique for producing novel finely divided amorphous magnetic cobalt-phosphorus particles 300 A and less having selectively controlled coercivity by controlled decomposition of a bath including a palladium cation catalyst having controlled concentrations. Additionally, the procedures and resulting Co-P particles taught by the present invention are unique, independent of its capacity for selectively controlling coercivity.

The production of magnetic recording media, for example, including particles having controlled coercivity can be critically important for data processing uses. This is so because such magnetic compositions may require that they be fabricated to possess a predetermined coercivity and thereby function predictably as recording media in the form of tapes, loops, drums, disks and the like. The coercivity desired may vary from one application to another. It is therefore seen that there is a great need for a technique for forming magnetic particles having predictable and reproducible controlled coercivity.

The use of catalytic material to assist in plating continuous metal films onto non-metallic surfaces by electroless techniques using hypophosphite anion reducing agents has been recognized since the inception of this technology by Brenner et al in U.S. Pat. Nos. 2,532,283 and 2,532,284. The use of palladium salts alone, or in conjunction with stannous chloride sensitizing solutions for plating continuous metal films onto non-metallic or non-catalytic surfaces, was taught in U.S. Pat. Nos. 2,690,402 and 2,702,253. From their first applications, electroless techniques were used to plate nominally magnetic films of cobalt, nickel and iron, but not in the form of recording media.

The application of electroless techniques to recording media production, including the step of applying a catalyst to the substrate, may first have been taught by U.S. Pat. Nos. 3,116,159 and 3,138,479. Specific requirements for the use of a catalyst, a review of the state of the art, and especially a catalyst solution of palladium chloride and hydrochloric acid, were set forth in U.S. Pat. No. 3,269,854. This latter reference teaches that cobalt film coercivity can be increased or controlled, independent of film thickness, by periodically interrupting the plating and re-exposing the plated surface to the catalytic solution. It does not suggest that the coercivity of plated cobalt film is a function of palladium cation concentration. Admittedly, various concentrations of palladium salts have been used in the prior art in various applications, but all such known uses had no apparent appreciation of any relationship between palladium cation concentration and plated cobalt coercivity.

The use of phosphoric acid or sulfuric acid with a palladium salt catalyst is taught by U.S. Pat. Nos. 3,423,226 and 3,437,507, respectively. It is believed that substitution of these and other acids for the hydrochloric acid of the present invention will provide equivalent results.

SUMMARY OF THE INVENTION

In accordance with the broad aspects of the present invention an aqueous bath is prepared including any soluble cobalt salt and any soluble source of hypophosphite anion at ambient temperatures of about 15° to about 35° C. A separate unheated solution of catalytic palladium cation material, such as palladium chloride and hydrochloric acid, is prepared in accordance with the present invention and added to the cobalt cation-hypophosphite solution, while maintaining the entire mixture at a neutral pH or in a state of slight acidity due to hydrolysis. No reaction, other than the possible formation of small amounts of palladium particles, occurs in such a non-basic bath. No control or heating of the ambient bath temperature is maintained. Then, a solution of unheated non-complexing basic material is added to the mixture. A blue gelatinous precipitate or flocculate of cobalt hyroxide is formed instantaneously, followed by reduction to and precipitation of small, amorphous, black cobalt-phosphorus alloy particles. In an alternative technique for producing cobalt alloy particles, an unheated solution of cobalt salt, hypophosphite anion and any non-complexing base, have added thereto an unheated solution containing palladium cation in accordance with the present invention. In this latter technique, small amorphous cobalt-phosphorus particles of controlled coercivity will form in accordance with the teachings of the present invention. Yet another technique for producing alloy particles in accordance with the present invention is the preparation of an unheated solution of non-complexing base, hypophosphite anion and catalytic material, to which a soluble cobalt solution is then added. Finally, in accordance with the present invention, cobalt cation, non-complexing base and catalytic material may be mixed and a solution of hypophosphite added thereto. In any of these procedures, one or more of the constituents, other than the catalyst, may be added to the unheated bath as the dry salt rather than as a solution. Cobalt complexing agents of all types are substantially excluded from all of these baths. Additionally, the reactions are normally carried out in the absence of magnetic fields of any type. Following cobalt-phosphorus preparation by any of these equivalent techniques, precipitated magnetic particles are separated from solution by filtering, decanting, centrifuging, magnetic separation or any other suitable means.

Extremely small, less than 300 A, uniform amorphous cobalt-phosphorus alloy particles having selectively controlled coercivities are formed by these reactions. The particles thus produced exhibit coercivities having an inverse dependence upon Pd cation catalyst constituent concentrations. The discovery of these relationships is very important.

Alloy particles produced in accordance with this invention display high intrinsic coercivities in the range of about 500 to 1500 oersteds, depending primarily on the palladium cation catalyst constituent concentration. They are in the form of amorphous finely divided uniform particles about 300 A or less in diameter.

The foregoing and other objects, features and advantages of the invention will be apparent from the following more particular description of preferred embodiments as illustrated in the accompanying drawings.

DESCRIPTION OF THE PREFERRED EMBODIMENTS

Figure 1:
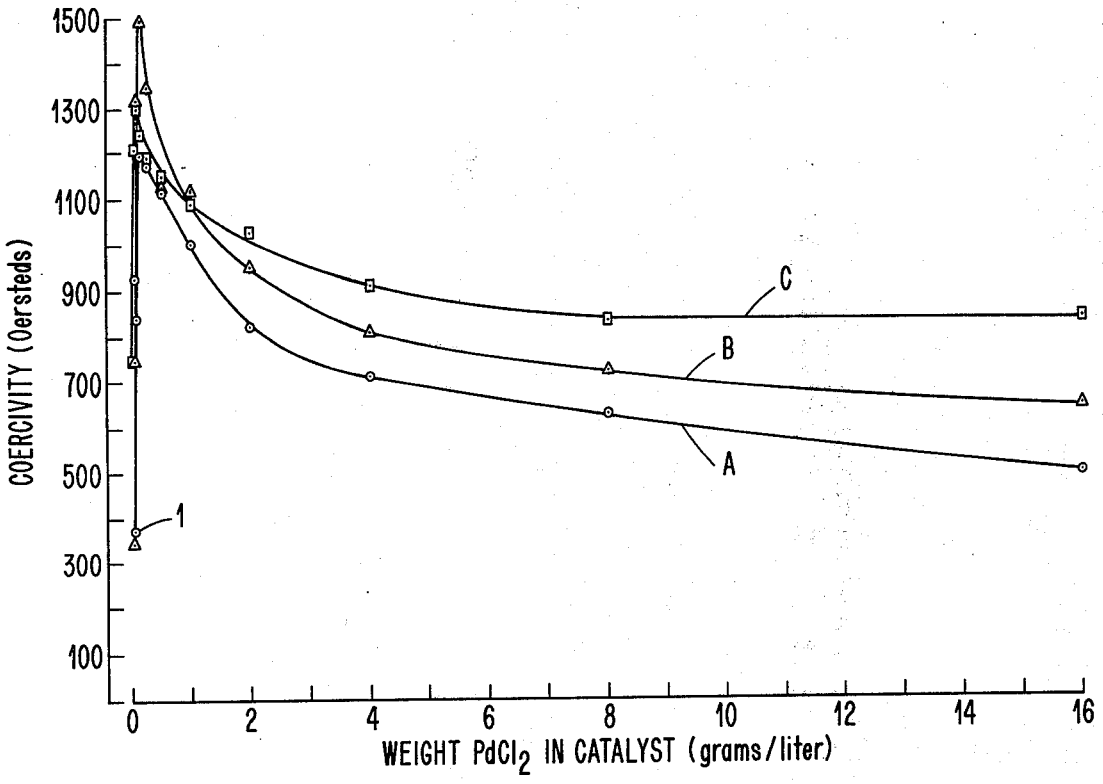
FIGS. 1 and 2 are graphical illustrations wherein the abscissa of said graph is concentration in grams/liter and the ordinate is coercivity in oersteds, said graphs showing the variation of coercivity in particles of cobalt-phosphorus produced by chemical reduction from baths of the cobalt cation-hypophosphite anion type at ambient temperatures in the substantial absence of cobalt complexing agents over a range of concentrations of palladium chloride catalyst solutions and for one series of examples rendered basic with a cobalt complexing base.

In the following examples, all solutions were prepared with distilled water and reagent grade chemicals. In each example, the total volume of the reaction mixture was approximately 233 ml. In order to bring the solutions together rapidly and completely agitation via gentle air driven non-magnetic stirring was normally employed. Particles produced by the method of the present invention were separated from the reaction mixture, usually magnetically, and washed with water and isopropyl alcohol. The particles were then dried, usually under non-oxidizing conditions with precautions taken to avoid exposing the particles to air, prior to and during drying.

Powder samples of the alloys tested were measured with a vibrating sample magnetometer, VSM, to determine their magnetic properties. Particle shapes were determined from electron micrographs of the particles. Particle sizes were determined by both electron micrographs and as a function of sample surface area and density. Particle morphology was determined by x-ray and electron diffraction.

While the products of the present invention consist predominantly of cobalt and are referred to as "cobalt-phosphorus", there is normally associated therewith small, but significant quantities of phosphorus, palladium and oxygen, as indicated by analysis. It would appear that during the course of reduction of the cobalt and palladium metal cations to metal, a small amount of the phosphorus in the hypophosphite anion is oxidized to the neutral state. The resulting phosphorus thereby formed is co-precipitated with the reduced metals to form an alloy. It further appears that during the washing and drying steps of the method, some small degree of oxidation of the surfaces of the particles occurs with the result that the final product contains oxygen which is limited almost entirely to the skin or shell of the particle. Techniques to avoid or control surface oxidation are known in the art.

This invention provides techniques for producing unique Co-P particles. The Co-P particles produced by this technique are novel as to both size and morphology. Their size is uniformly less than about 300 A, with average sizes being about 150 A. This is substantially smaller than Co-P particles previously known or reported in the literature. Their morphology is unique, as shown by x-ray diffraction and electron diffraction, in that they are amorphous. All known prior art Co-P particles have been crystalline, normally with a hexagonal structure. In addition, these unique Co-P particles have the capability of being manufactured with controlled magnetic coercivity.

The new reaction system utilized to produce these unique materials provides a substantial departure from art known systems. The reaction system is notable both for changes in materials and procedures previously considered important or indispensable to the production of magnetic Co-P and for its ability to control the coercivity of the particles produced over a broad range as an inverse function of the concentration of the palladium cation ($Pd^{++}$) catalyst used. More specifically, the reaction system is extremely novel in terms of the fact that: (1) it is initiated at ambient rather than elevated temperatures; (2) excludes all complexing agents, both strong and weak, from the reaction system; (3) excludes magnetic fields of every form and magnitude during the reaction; and (4) can be utilized to provide Co-P particles of selected coercivity as a function of the Pd cation catalyst concentration.

The realization of this invention is based upon substantial experimental data, as reported below.

The cobalt cation is provided by the use of almost any suitable soluble cobalt salt, such as cobalt chloride, cobalt sulfate, cobalt acetate, cobalt sulfamate and others. Cobalt sulfate heptahydrate ($CoSO_4 \cdot 7H_2O$) is generally preferred. The concentration range of cobalt cation as a function of the entire reaction bath does not appear to be critical and has been successfully varied from about $1.9 \times 10^{-2}$M. to about $7.6 \times 10^{-2}$M.

The hypophosphite anion is normally brought into solution in the form of an alkaline metal salt, although other hypophosphites, including ammonium hypophosphite ($NH_4H_2PO_2$) are also suitable. When ammonium hypophosphite is utilized the amount of ammonia ($NH_3$) formed by hydrolysis is apparently not sufficient to complex with the cobalt cations to an extent which will interfere with the present invention. The concentration of hypophosphite anion as a function of the entire bath does not appear to be critical and has been successfully varied from about 0.10M. to 0.40M.

As will be appreciated more completely by reference to the following examples, palladium cation concentration has been widely varied in the catalyst solution from about $8.8 \times 10^{-5}$M. to about $9.0 \times 10^{-2}$M. while holding HCl concentration substantially fixed at about 0.12M. In the total reaction bath palladium cation concentration has been varied from about $3.0 \times 10^{-6}$M. to about $3.1 \times 10^{-3}$M. while holding HCl concentration at about $4.1 \times 10^{-3}$M.

Reference to FIG. 1 and the following examples indicates that substantial changes in $CO^{++}$, $H_2PO_2^-$ and HCl concentration have little effect on Co-P particle coercivity under the process taught and claimed, whereas modifications in $Pd^{++}$ concentration over a wide range effects substantially controlled and reproducible changes in particle coercivity.

Unlike the prior art reactions of $Co^{++}$ with $H_2PO_2^-$, in the present invention, weak complexing agents, such as citrates and malonates are intentionally excluded from the reaction mixture. Strong complexing agents such as ammonia and ammonium compounds which hydrolyze to liberate large amounts of ammonia are also generally excluded from the bath as completely as possible.

The pH of the reaction mixture is controlled by the use of hydroxide anions (OH—) brought into solution to provide a reaction pH of from about 7.1 to 13. Bases other than ammonium hydroxide, and preferably in a form having a cation portion which does not complex with cobalt cation are utilized to provide hydroxide anions. Alkaline hydroxides, such as sodium hydroxide and potassium hydroxide, are preferred.

With further regard to complexing constituents, it is specifically required as a part of this invention that substantially no complexing agents of any kind be present in the bath prior to alloy formation. As used herein, the terms "strong complex", "strong complexing agent", and "complexing base" are intended to mean an ingredient which combines with cobalt cation in solution to form a stable complex of any type. The terms "weak complex", "weak complexing agent", "non-complexing" and "non-complexing base" are defined to mean ingredients which when present with cobalt cation in solution form an unstable complex with the cobalt cation.

The following examples are given merely to aid in the understanding of the invention, and variations may be made by one skilled in the art without departing from the spirit of the invention.

EXAMPLE 1

An aqueous room temperature solution containing 1.25g cobalt sulfate ($CoSO_4 \cdot 7H_2O$), and 2.5g sodium hypophosphite ($NaH_2PO_2 \cdot H_2O$) in 200 ml of water was prepared. This solution was not heated. To it was added, without reaction, 8 ml of a 1/64g/1 $PdCl_2$—10 ml/1 Con. (37%) HCl solution. A separate ambient solution of 50% sodium hydroxide (NaOH) was prepared and 25 ml of base ambient solution was poured into the cobalt cation-hypophosphite anion bath with stirring. A gelatinous blue cobalt hydroxide solution was formed instantaneously, followed by a vigorous exothermic reaction during which a black, finely divided precipitate was formed. This reaction was allowed to proceed to completion, the precipitate washed thoroughly with water three times and with isopropyl alcohol once and then dried.

A portion of the resulting particles were packed in a glass cylinder for measurement of magnetic properties by the VSM. The intrinsic coercive force was 374 oersteds. The results of this example have been placed on FIG. 1, on curve A as point 1 in the plot of catalyst concentration versus coercive field. This data is also summarized in Table I.

Electron micrographs of the powder produced by Example 1 indicated that it consisted of spherical particles, less than about 300 A in diameter and having an average diameter of about 164 A. X-ray and electron diffraction analysis failed to indicate any crystal structure, thereby leading to the conclusion that the particles are amorphous. When added to polymeric binder solutions of the kind used to produce magnetic media, the particles were found to disperse well.

EXAMPLES 2–11

The bath of each of these examples was prepared substantially in accordance with the same procedures and details set forth in Example 1, and as in Example 1, had the following composition:

| | |
|---|---|
| 1.25g $CoSO_4 \cdot 7H_2O$ in | 100 ml. of water |
| 2.5g $NaH_2PO_2 \cdot H_2O$ in | 100 ml. of water |
| Xg/l $PdCl_2$ + 10 ml/l conc. HCl | 8 ml. |
| 50% NaOH | 25 ml. |
| Total Volume | 233 ml. |

However, the grams "X" per liter of $PdCl_2$ were varied from 1/32g to 16g, as detailed in Table I. Table I and curve A in FIG. 1 show the results of these experiments. Each reaction was allowed to proceed to completion. The formation of blue cobalt hydroxide followed by the formation of a black precipitate of finely divided (less than about 300 A) amorphous cobalt-phosphorus alloy was noted in each reaction. The coercivity was obtained for each of the examples by the standard techniques previously described, while for some samples additional data was obtained which is listed in the Table.

The magnetic coercivity values of the examples were plotted against the weight of $PdCl_2$ in the catalyst solution in FIG. 1 as curve A. It is, thereby seen that by merely selecting the $PdCl_2$ concentration of the catalyst solution as indicated by curve A, cobalt-phosphorus alloy particles may be produced with the desired coercivity in the range of about 1200 to 500 oersteds by selecting $PdCl_2$ concentration in the catalyst solution of about 1/8 to 16 grams/liter. This corresponds to Pd cation concentrations of about $7.0 \times 10^{-4}$M. to about $9.0 \times 10^{-2}$M. in the entire 233 ml. bath.

TABLE I

| Example | $PdCl_2$, in g/l | Molarity $Pd^{++}$ in Catalyst | Molarity $Pd^{++}$ in Entire Bath | Coercivity, in Oersteds | Moment, in em$\mu$/g | Weight % P | Weight % Pd |
|---|---|---|---|---|---|---|---|
| 1 | 1/64 | $8.8 \times 10^{-5}$ | $3.0 \times 10^{-6}$ | 374 | — | — | — |
| 2 | 1/32 | $1.8 \times 10^{-4}$ | $6.0 \times 10^{-6}$ | 926 | — | — | — |
| 3 | 1/16 | $3.5 \times 10^{-4}$ | $1.2 \times 10^{-5}$ | 841 | 62 | 1.35 | 0.098 |
| 4 | 1/8 | $7.0 \times 10^{-4}$ | $2.4 \times 10^{-5}$ | 1196 | 55 | 1.35 | 0.22 |
| 5 | 1/4 | $1.4 \times 10^{-3}$ | $4.8 \times 10^{-5}$ | 1170 | 66 | 1.36 | 0.35 |
| 6 | 1/2 | $2.8 \times 10^{-3}$ | $9.6 \times 10^{-5}$ | 1114 | 59 | 1.36 | 0.68 |
| 7 | 1 | $5.6 \times 10^{-3}$ | $1.9 \times 10^{-4}$ | 1002 | 79 | 1.51 | 1.43 |
| 8 | 2 | $1.1 \times 10^{-2}$ | $3.8 \times 10^{-4}$ | 822 | 54 | 1.56 | 2.62 |
| 9 | 4 | $2.2 \times 10^{-2}$ | $7.7 \times 10^{-4}$ | 710 | 56 | 1.92 | 4.95 |
| 10 | 8 | $4.5 \times 10^{-2}$ | $1.5 \times 10^{-3}$ | 628 | 43 | 2.37 | 6.03 |
| 11 | 16 | $9.0 \times 10^{-2}$ | $3.1 \times 10^{-3}$ | 500 | — | — | — |

EXAMPLES 12–22

To determine the effects of cobalt cation concentration and hypophosphite anion concentration, a series of additional samples having greater concentrations of these two constituents were prepared as Examples 12–22. Each of these baths was prepared in accordance with the procedure of Example 1, and had the following composition:

| | |
|---|---|
| 2.5g $CoSO_4 \cdot 7H_2O$ in | 100 ml. of water |
| 5.0g $NaH_2PO_2 \cdot H_2O$ in | 100 ml. of water |
| Xg/l $PdCl_2$ + 10 ml/l conc. HCl | 8 ml. |
| 50% NaOH | 25 ml. |

As in Examples 1–11, the grams, "X", per liter of $PdCl_2$ were varied from 1/64g to 16g, as shown in Table II. Table II also shows the results of these examples, and the results have also been plotted on FIG. 1 as curve B. The particles produced in each example were amorphous and uniformly less than about 300 A, and found to disperse well in polymeric binder solutions. It is immediately clear that in the range of about 1/8g/l to 16g/l of $PdCl_2$ cobalt-phosphorus alloy particles are produced which exhibit an inverse relationship to Pd cation concentration or weight, and that this relationship is quite similar to that of curve A. It would therefore appear that the relationship herein reported is substantially independent of $Co^{++}$ and $H_2PO_2^-$ concentration.

TABLE II

| Example | $PdCl_2$, in g/l | Molarity $Pd^{++}$ in Catalyst | Molarity $Pd^{++}$ in Bath | Coercivity, in Oersteds |
|---|---|---|---|---|
| 12 | 1/64 | $8.8 \times 10^{-5}$ | $3.0 \times 10^{-6}$ | 348 |
| 13 | 1/32 | $1.8 \times 10^{-4}$ | $6.0 \times 10^{-6}$ | 748 |
| 14 | 1/16 | $3.5 \times 10^{-4}$ | $1.2 \times 10^{-5}$ | 1320 |
| 15 | 1/8 | $7.0 \times 10^{-4}$ | $2.4 \times 10^{-5}$ | 1496 |
| 16 | 1/4 | $1.4 \times 10^{-3}$ | $4.8 \times 10^{-5}$ | 1346 |
| 17 | 1/2 | $2.8 \times 10^{-3}$ | $9.6 \times 10^{-5}$ | 1126 |
| 18 | 1 | $5.6 \times 10^{-3}$ | $1.9 \times 10^{-4}$ | 1118 |
| 19 | 2 | $1.1 \times 10^{-2}$ | $3.8 \times 10^{-4}$ | 954 |
| 20 | 4 | $2.2 \times 10^{-2}$ | $7.7 \times 10^{-4}$ | 812 |
| 21 | 8 | $4.5 \times 10^{-2}$ | $1.5 \times 10^{-3}$ | 722 |
| 22 | 16 | $9.0 \times 10^{-2}$ | $3.1 \times 10^{-3}$ | 647 |

EXAMPLES 23–33

A further series of examples were conducted to confirm the independence of the relationship found for coercivity and Pd cation concentration from $Co^{++}$ and $H_2PO_2^-$ concentration. Again each of these experiments was prepared in accordance with the procedure of Example I, and had the following composition:

| | |
|---|---|
| 5.0g $CoSO_4.7H_2O$ in | 100 ml. of water |
| 10.0g $NaH_2PO_2.H_2O$ in | 100 ml. of water |
| Xg/l $PdCl_2$ + 10 ml/l conc. HCl | 8 ml. |
| 50% NaOH | 25 ml. |

As in the previous sets of examples, the grams "X" per liter of $PdCl_2$ were varied from 1/64g to 16g, as detailed in Table III. Table III and curve C in FIG. 1 shows the results of these experiments. The inverse relationship of coercivity, to $Pd^{++}$ concentration greater than about $3.5 \times 10^{-4}$M. is confirmed and the substantial independence of this relationship to the concentration of $Co^{++}$ and $H_2PO_2^-$ is again shown.

TABLE III

| Example | $PdCl_2$, in g/l | Molarity $Pd^{++}$ in Catalyst | Molarity $Pd^{++}$ in Bath | Coercivity, in Oersteds |
|---|---|---|---|---|
| 23 | 1/64 | $8.8 \times 10^{-5}$ | $3.0 \times 10^{-6}$ | 745 |
| 24 | 1/32 | $1.8 \times 10^{-4}$ | $6.0 \times 10^{-6}$ | 1206 |
| 25 | 1/16 | $3.5 \times 10^{-4}$ | $1.2 \times 10^{-5}$ | 1300 |
| 26 | 1/8 | $7.0 \times 10^{-4}$ | $2.4 \times 10^{-5}$ | 1240 |
| 27 | 1/4 | $1.4 \times 10^{-3}$ | $4.8 \times 10^{-5}$ | 1191 |
| 28 | 1/2 | $2.8 \times 10^{-3}$ | $9.6 \times 10^{-5}$ | 1149 |
| 29 | 1 | $5.6 \times 10^{-3}$ | $1.9 \times 10^{-4}$ | 1092 |
| 30 | 2 | $1.1 \times 10^{-2}$ | $3.8 \times 10^{-4}$ | 1028 |
| 31 | 4 | $2.2 \times 10^{-2}$ | $7.7 \times 10^{-4}$ | 911 |
| 32 | 8 | $4.5 \times 10^{-2}$ | $1.5 \times 10^{-3}$ | 835 |
| 33 | 16 | $9.0 \times 10^{-2}$ | $3.1 \times 10^{-3}$ | 839 |

EXAMPLES 34–42

Cobalt cations from a source other than $CoSO_4 \cdot 7H_2O$ was utilized in the next series of experiments. In Examples 34–42, $CoCl_2 \cdot 6H_2O$ was used as the source of $Co^{++}$. Each of the baths was again prepared in accordance with the procedure of Example 1, and had the following composition:

| | |
|---|---|
| 1.25g $CoCl_2.6H_2O$ in | 100 ml. of water |
| 2.5g $NaH_2PO_2.H_2O$ in | 100 ml. of water |
| Xg/l $PdCl_2$ + 10 ml/l conc. HCl | 8 ml. |
| 50% NaOH | 25 ml. |

In this series of examples, the grams "X" per liter $PdCl_2$ were varied from 1/16g to 16g, as shown in Table IV. The results are plotted in FIG. 2 as curve D. Curve A from FIG. 1 is reproduced in FIG. 2 to provide a source of comparison between these similar sets of experiments. Reference to Examples 1–11 will indicate that their only substantial variation from Examples 34–42 resides in the source of $Co^{++}$. Now comparison between curves A and D in FIG. 2 indicates that in the range from about $1.4 \times 10^{-3}$M. to about $9.0 \times 10^{-2}$M. Pd cation in the total bath, the relationship between coercivity and catalyst concentration is substantially independent of the source of cobalt cation.

TABLE IV

| Example | $PdCl_2$, in g/l | Molarity $Pd^{++}$ in Catalyst | Molarity $Pd^{++}$ in Bath | Coercivity in Oersteds |
|---|---|---|---|---|
| 34 | 1/16 | $3.5 \times 10^{-4}$ | $1.2 \times 10^{-5}$ | 441 |
| 35 | 1/8 | $7.0 \times 10^{-4}$ | $2.4 \times 10^{-5}$ | 591 |
| 36 | 1/4 | $1.4 \times 10^{-3}$ | $4.8 \times 10^{-5}$ | 1137 |
| 37 | 1/2 | $2.8 \times 10^{-3}$ | $9.6 \times 10^{-5}$ | 1100 |
| 38 | 1 | $5.6 \times 10^{-3}$ | $1.9 \times 10^{-4}$ | 976 |
| 39 | 2 | $1.1 \times 10^{-2}$ | $3.8 \times 10^{-4}$ | 853 |
| 40 | 4 | $2.2 \times 10^{-2}$ | $7.7 \times 10^{-4}$ | 718 |
| 41 | 8 | $4.5 \times 10^{-2}$ | $1.5 \times 10^{-3}$ | 636 |
| 42 | 16 | $9.0 \times 10^{-2}$ | $3.1 \times 10^{-3}$ | 520 |

EXAMPLES 43–53

In this series of experiments, ammonium hypophosphite ($NH_4H_2PO_2$) was used as the source of hypophosphite anions. Each of the baths was again prepared in accordance with the procedure of Example 1, and had the following composition:

| | |
|---|---|
| 1.25g $CoSO_4.7H_2O$ in | 100 ml. of water |
| 5.0g $NH_4H_2PO_2$ in | 100 ml. of water |
| Xg/l $PdCl_2$ + 10 ml/l conc. HCl | 8 ml. |
| 50% NaOH | 25 ml. |

The grams "X" per liter $PdCl_2$ were varied from 1/64g to 16g, as shown in Table V. The results are also plotted as curve E in FIG. 2. By comparison with curve A, it is seen that the relationship between coercivity and catalyst concentration appears to be substantially independent of the source of hypophosphite cation.

TABLE V

| Example | $PdCl_2$, in g/l | Molarity $Pd^{++}$ in Catalyst | Molarity $Pd^{++}$ in Bath | Coercivity, in Oersteds |
|---|---|---|---|---|
| 43 | 1/64 | $8.8 \times 10^{-5}$ | $3.0 \times 10^{-6}$ | 435 |
| 44 | 1/32 | $1.8 \times 10^{-4}$ | $6.0 \times 10^{-6}$ | 469 |
| 45 | 1/16 | $3.5 \times 10^{-4}$ | $1.2 \times 10^{-5}$ | 578 |
| 46 | 1/8 | $7.0 \times 10^{-4}$ | $2.4 \times 10^{-5}$ | 1100 |
| 47 | 1/4 | $1.4 \times 10^{-3}$ | $4.8 \times 10^{-5}$ | 1066 |
| 48 | 1/2 | $2.8 \times 10^{-3}$ | $9.6 \times 10^{-5}$ | 975 |
| 49 | 1 | $5.6 \times 10^{-3}$ | $1.9 \times 10^{-4}$ | 907 |
| 50 | 2 | $1.1 \times 10^{-2}$ | $3.8 \times 10^{-4}$ | 760 |
| 51 | 4 | $2.2 \times 10^{-2}$ | $7.7 \times 10^{-4}$ | 752 |
| 52 | 8 | $4.5 \times 10^{-2}$ | $1.5 \times 10^{-3}$ | 643 |
| 53 | 16 | $9.0 \times 10^{-2}$ | $3.1 \times 10^{-3}$ | 571 |

EXAMPLES 54–60

In order to determine the effect of the variation of the other portion of the catalyst solution, the hydrochloric acid, a series of experiments varying HCl concentration were conducted. Each of the baths was again prepared in accordance with the procedure of Example 1, and had the following composition:

| | |
|---|---|
| 1.25g $CoSO_4.7H_2O$ in | 100 ml. of water |

-continued

| | |
|---|---|
| 2.5g $NaH_2PO_2.H_2O$ in | 100 ml. of water |
| 1g/l $PdCl_2$ + Yml/l conc. HCl | 8 ml. |
| 50% NaOH | 25 ml. |

The mililiters "Y" per liter HCl were varied from 2 mililiters to 128 mililiters, as shown in Table VI. Review of the results in Table VI indicate no clear trend for changes in coercivity as a function of HCl concentration. It is therefore suggested that there is no overriding relationship between HCl concentration and the relationship found between coercivity and palladium anion concentration.

The results of Examples 54–60 are not included in the figures accompanying this application.

TABLE VI

| Example | Conc. HCl in ml/l | Molarity HCl in Catalyst | Molarity HCl in Bath | Coercivity, in Oersteds |
|---|---|---|---|---|
| 54 | 2 | $2.4 \times 10^{-2}$ | $8.2 \times 10^{-4}$ | 822 |
| 55 | 4 | $4.8 \times 10^{-2}$ | $1.6 \times 10^{-3}$ | 942 |
| 56 | 8 | $9.6 \times 10^{-2}$ | $3.3 \times 10^{-3}$ | 1028 |
| 57 | 16 | 0.19 | $6.6 \times 10^{-3}$ | 1001 |
| 58 | 32 | 0.38 | $1.3 \times 10^{-2}$ | 1009 |
| 59 | 64 | 0.77 | $2.6 \times 10^{-2}$ | 975 |
| 60 | 128 | 0.5 | $5.2 \times 10^{-2}$ | 1074 |

EXAMPLES 61–68

In order to determine the effect of a complexing agent on the relationship of coercivity to catalyst concentration, a series of experiments using ammonium hydroxide as the base were conducted. Each of the reactions was prepared in accordance with the procedure of Example 1, and had the following composition:

| | |
|---|---|
| 1.25g $CoSO_4.7H_2O$ in | 100 ml. of water |
| 2.5g $NaH_2PO_2.H_2O$ in | 100 ml. of water |
| Xg/l $PdCl_2$ + 10 ml/l conc. HCl | 8 ml. |
| 28–30% $NH_4OH$ | 25 ml. |

The grams "X" per liter $PdCl_2$ were varied from 1/32g to 16g, as shown in Table VII. The results are plotted in FIG. 2 as curve F. Comparing curve F with curve A, D or E indicates a narrow not readily controllable relationship between coercivity and palladium cation concentration can be found when $NH_4OH$, a complexing base, is used in the reaction system.

TABLE VII

| Example | $PdCl_2$, in g/l | Molarity $Pd^{++}$ in Catalyst | Molarity $Pd^{++}$ in Bath | Coercivity, in Oersteds |
|---|---|---|---|---|
| 61 | 1/32 | $1.8 \times 10^{-4}$ | $6.0 \times 10^{-6}$ | 416 |
| 62 | 1/4 | $1.4 \times 10^{-3}$ | $4.8 \times 10^{-5}$ | 714 |
| 63 | 1/2 | $2.8 \times 10^{-3}$ | $9.6 \times 10^{-5}$ | 597 |
| 64 | 1 | $5.6 \times 10^{-3}$ | $1.9 \times 10^{-4}$ | 454 |
| 65 | 2 | $1.1 \times 10^{-2}$ | $3.8 \times 10^{-4}$ | 321 |
| 66 | 4 | $2.2 \times 10^{-2}$ | $7.7 \times 10^{-4}$ | 299 |
| 67 | 8 | $4.5 \times 10^{-2}$ | $1.5 \times 10^{-3}$ | 276 |
| 68 | 16 | $9.0 \times 10^{-2}$ | $3.1 \times 10^{-3}$ | 276 |

It must be understood that curves A, B, C, D and E are indicative of the inverse dependence which exists between coercivity and palladium cation concentration in uncomplexed baths of this invention generally and that variations of factors other than those already detailed may cause the curves to raise, lower or vary their slopes while still maintaining the inverse dependence noted for bath concentrations of palladium cation greater than about $7.0 \times 10^{-4}$M.

A series of related experiments have measured other bath parameters of interest. As has been experimentally shown above, the strength of the cobalt cation or hypophosphite anion concentration, in the absence of complexing ingredients has little effect upon the palladium concentration-coercivity relationship of the resulting particles. Neither does mechanical non-magnetic agitation of the solution, as tested up to several hundred RPM, have any significant effect on the magnetic characteristics of the particles. It has been found that pH has the expected effect. It is therefore seen that the single previously unexpected control of the coercivity of cobalt-phosphorus particles as produced by chemical reduction, from an ambient bath in the absence of complexing ingredients is palladium concentration selection. As has been previously noted, the hypophosphite anion is normally brought into solution in the form of an alkaline hypophosphite. While preferred concentrations are indicated, the present invention is operative utilizing either trace amounts or saturated solutions of the oxidizing and reducing agents. Unlike the prior art, in the preferred embodiments, weak complexing agents, such as citrates and malonates, are intentionally excluded from the reaction mixture. Ammonia, compounds which hydrolyze to form substantial amounts of ammonia, and other strong complexing agents are also excluded from the bath as completely as possible.

The process of this invention is normally carried out under atmospheric conditions. However, moderate variations in pressure may sometimes be desirable. While a convenient method for carrying out the process of this invention is to place reaction ingredients in a suitable container, such as glass, resin, or non-magnetic stainless steel, the invention may easily be modified for continuous operation. Reactants may be introduced into a reaction vessel or tube in appropriately proportioned quantities, and the reaction mixture, including the reaction products, continuously withdrawn. With this latter type of operation, much larger quantities of reactants can be efficiently and conveniently processed.

The absence of both weak and strong complexing agents and buffering materials in the reaction bath is a matter of absolute necessity. In the prior art these materials, and the techniques of using them, were used to control the availability of various ions in the bath.

Uses for the materials produced in the foregoing examples are well known. The ferromagnetic alloy particles produced by the foregoing examples have been coated with non-magnetic organic film-forming materials. These coating materials have included organic polymers or non-magnetic fillers which have known utility in the preparation of magnetic recording media.

Typical, but not limiting, binders for preparing various recording media including ferromagnetic particles produced in accordance with this invention are polyesters, cellulose esters and ethers, vinyl chloride, vinyl acetate, vinylidene chloride polymers and copolymers, acrylate and styrene polymers and co-polymers, linear and cross-linked polyurethanes, polyamides, aromatic polycarbonates and polyphenyl ethers, and mixtures thereof.

A wide variety of solvents may be used for forming a dispersion of the ferromagnetic particles and binders. Organic solvents, such as ethyl, butyl, and amyl acetate, isopropyl alcohol, dioxane, acetone, methylisobutyl and methyl ethyl ketone, cyclohexanone, tetrahydrofuran and toluene are useful for this purpose. Additives to control dispersion, lubrication, conductivity and the growth of bacteria or fungus may also be used. The particle-binder dispersion may be applied to a suitable substrate by roller coating, gravure coating, knife coating, extrusion, or spraying of the mixture onto the substrate or by other known methods. The specific choice of non-magnetic substrate, binder, solvent or method of application of the magnetic composition to the support will vary with the properties desired and the specific form of the magnetic recording medium being produced.

In preparing recording media, the magnetic particles usually comprise about 40 % to 90 %, by weight, of the solids in the film layer applied to the substrate. The substrate is often a flexible resin, such as polyester or cellulose acetate material; although other flexible materials as well as rigid base materials are more suitable for some uses.

In preparing magnetic cores and permanent magnets, the products of the examples are mixed with non-magnetic plastic or filler in amounts up to about 50 %, by volume, of the magnetic material; the particles aligned in a magnetic field; and the mixture pressed into a firm magnet structure.

While the invention has been particularly shown and described with reference to preferred embodiments thereof, it will be understood by those skilled in the art that various changes in form and details may be made therein without departing from the spirit and scope of the invention.

What is claimed is:

1. A method for preparing finely divided amorphous magnetic cobalt-phosphorus alloy particles about 300 A or less in diameter with average size of about 150 A, said process comprising the steps of preparing an aqueous solution consisting essentially of reducible cobalt cations, hypophosphite anions as a reducing agent, a non-complexing base as a source of hydroxide anions to render the solution basic, and a source of reducible palladium cations to provide catalystic nucleating sites for cobalt-phosphorus particle formation;

wherein the improvement comprises initiating an oxidation-reduction reaction to produce finely divided amorphous magnetic cobalt-phosphorus alloy particles about 300 A or less in diameter with an average size of about 150 A while excluding both strong and weak cobalt cation complexing agents from said solution substantially excluding magnetic fields of all types and magnitudes from affecting the solution during the reaction, and maintaining said solution at ambient temperatures in the range of about 15° C to about 35° C at the time the reaction is initiated.

2. The method of claim 1 wherein the cobalt cation concentration is in the range of about $1.9 \times 10^{-2}$M. to $7.6 \times 10^{-2}$M., the concentration of hypophosphite anion is in the range of about 0.10M. to 0.40M., the palladium concentration is in the range of about $3.0 \times 10^{-6}$M. to $3.1 \times 10^{-3}$M., and the pH of the solution is in the range of about 7.1 to about 13.

3. A method for preparing finely divided amorphous magnetic cobalt-phosphorus alloy particles having selected coercivity, said process comprising preparing an aqueous solution at ambient temperatures consisting essentially of reducible cobalt cations, hypophosphite anions as a reducing agent, a non-complexing base as a source of hydroxide anions to render the solution basic, and palladium cations to provide nucleating sites for cobalt-phosphorus particle formation;

wherein the improvement comprises maintaining the solution at ambient temperatures in the range of about 15° C to about 35° C while excluding both strong and weak cobalt cation complexing agents and magnetic fields of every type and magnitude;

selecting the concentration of palladium cations in the bath in the range of about $7.0 \times 10^{-4}$M. to $9.0 \times 10^{-2}$M.; and then initiating an oxidation-reduction reaction to produce finely divided magnetic cobalt-phosphorus alloy particles by reduction of the cobalt cations by the hypophosphite anions, the coercivity of said particles being inversely and functionally dependent on the palladium cation concentration of the solution at the time the reaction is initiated.

Figure 2:
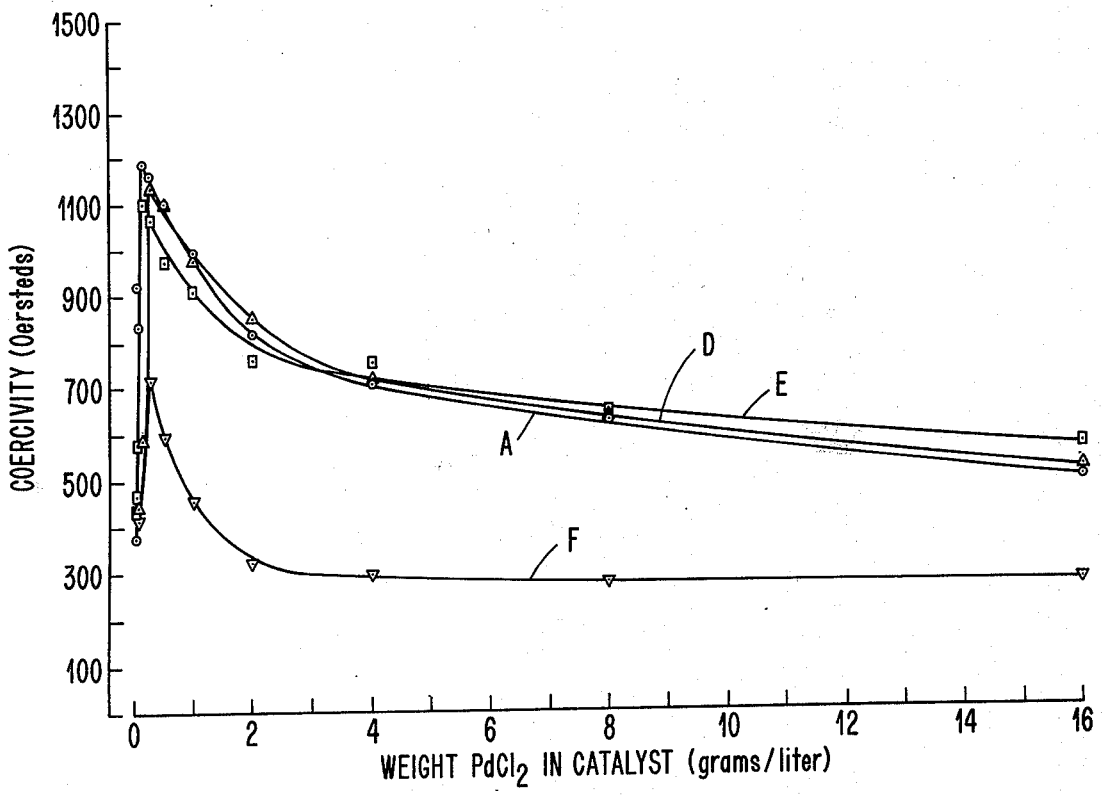

4. A method for preparing finely divided amorphous magnetic cobalt-phosphorus alloy particles having selected coercivity, said process comprising preparing an aqueous solution at ambient temperatures consisting essentially of reducible cobalt cations, hypophosphite anions as a reducing agent, a noncomplexing base as a source of hydroxide anions to render the solution basic, and palladium cations to provide nucleating sites for cobaltphosphorus particle formation;

wherein the improvement comprises maintaining the solution at ambient temperatures in the range of about 15° C to about 35° C while excluding both strong and weak cobalt cation complexing agents and magnetic fields of every type and magnitude;

selecting the concentration of palladium cations in the range of about $7.0 \times 10^{-4}$M. to $9.0 \times 10^{-2}$M.; and then initiating an oxidation-reduction reaction to produce finely divided magnetic cobaltphosphorus alloy particles by reduction of the cobalt cation by the hypophosphite anions, said particles having controlled coercivity in the range of about 500 to 1500 oersteds, said coercivity being inversely and functionally dependent on the palladium cation concentration in the catalyst solution at the time the reaction is initiated, substantially as set forth in curves A, B, C, D and E of FIGS. 1 and 2.

5. A method for making a magnetic coating composition for use in the manufacture of magnetic recording media consisting of the steps of:

bringing together particles produced in accordance with the process of claim 1 with an organic resin binder and solvent therefor; and then mixing said particles and resin to produce a mixture.

6. The method of claim 5 wherein said binder includes polyurethane.

7. The product produced by the process of claim 1.

8. The product produced by the process of claim 5.

* * * * *